United States Patent [19]

Fink

[11] Patent Number: 4,903,863

[45] Date of Patent: Feb. 27, 1990

[54] SECURITY SYSTEM

[76] Inventor: Jeffrey L. Fink, 832 W. 1st St., Birdsboro, Pa. 19508

[21] Appl. No.: 33,349

[22] Filed: Apr. 1, 1987

[51] Int. Cl.[4] ..... B65D 83/14

[52] U.S. Cl. ..... 222/61; 222/162; 116/75

[58] Field of Search ..... 116/75, 81, 94, 6; 239/274; 169/23

[56] References Cited

U.S. PATENT DOCUMENTS

| | | | |
|---|---|---|---|
| 3,957,012 | 5/1976 | Fegley et al. | 116/81 X |
| 3,967,757 | 7/1976 | Fegley | 222/162 X |
| 4,018,361 | 4/1977 | Fegley | 222/162 X |
| 4,055,277 | 10/1977 | Fegley et al. | 116/75 X |
| 4,068,780 | 1/1978 | Fegley | 222/61 X |
| 4,079,862 | 3/1978 | Fegley | 222/162 |
| 4,118,691 | 10/1978 | Sims | 116/6 X |

FOREIGN PATENT DOCUMENTS

| | | | |
|---|---|---|---|
| 0933555 | 8/1963 | United Kingdom | 222/162 |

*Primary Examiner*—Daniel M. Yasich

*Attorney, Agent, or Firm*—Leonard M. Quittner

[57] ABSTRACT

An open cylinder adapted to receive a tear gas canister has a trigger mechanism that holds the canister well above the bottom of the cylinder. When the device is activated by an intruder, the operating mechanism withdraws trigger mechanism from under the cylinder, frees the cylinder to fall by gravity against an impact plate, which inturn, opens the canister value so that tear gas is discharged into the surrounding environment.

1 Claim, 2 Drawing Sheets

SECURITY SYSTEM

CROSS-REFERENCES

There are no cross-references to this application nor are there related applications.

FEDERALLY-SPONSORED RIGHTS

The invention herein was made without any Federal sponsorship or contribution.

BACKGROUND OF THE INVENTION

1. The Field of the Invention

This invention relates to a security system for a building and more particularly to a system that disperses tear gas or other noxious gas when an activating mechanism is tripped by an intruder.

2. Description of the Prior Art

The need for anti-bugular devices as in a home, office or store is well established. Many of these security devices are designed to sound an alarm which, may be either an audible one on the premises or a silent one communicated by telephone wires to a monitoring station. Depending upon the speed of response, if any, by neighbors or the police, intruders can often complete a bugularly and retreat without apprehension.

Another type of device, of the sort with which this invention is concerned, makes use of an noxious gas, such as tear gas, to drive an intruder from the premises immediately and without need for the response of a law enforcement officer. A representative security device of this latter type is illustrated, for example, in U.S. Pat. No. 4,068,780. This patent illustrates a canister containing tear gas mounted within a closed chamber and resting upon a bi-metal support. When the alarm is tripped an electric current flows through a resistance wire in contact with the bi-metal. The heat generated in the wire causes the bi-metal to curl upwardly and the canister is forced against a mechanism which triggers the release of tear gas.

Representative of other security devices of this general type are illustrated, for example, in patent 4,118,691 which shows a device that is triggered by a detection wire, either to release tear gas or to sound an alarm, or both.

SUMMARY OF THE INVENTION

It is an object of this invention to provide a security device which, when triggered by an intruder, releases a noxious gas, such as tear gas, into the surrounding area.

Another object of this invention is to provide a protective device of the type defined which, when tripped by either electrical or mechanical forces, will discharge a noxious gas into the immediate surrounding area.

These and other objects of this invention can be better understood by reference to the drawings which accompany this specification.

DETAILED DESCRIPTION OF THE DRAWINGS

Figure 1:
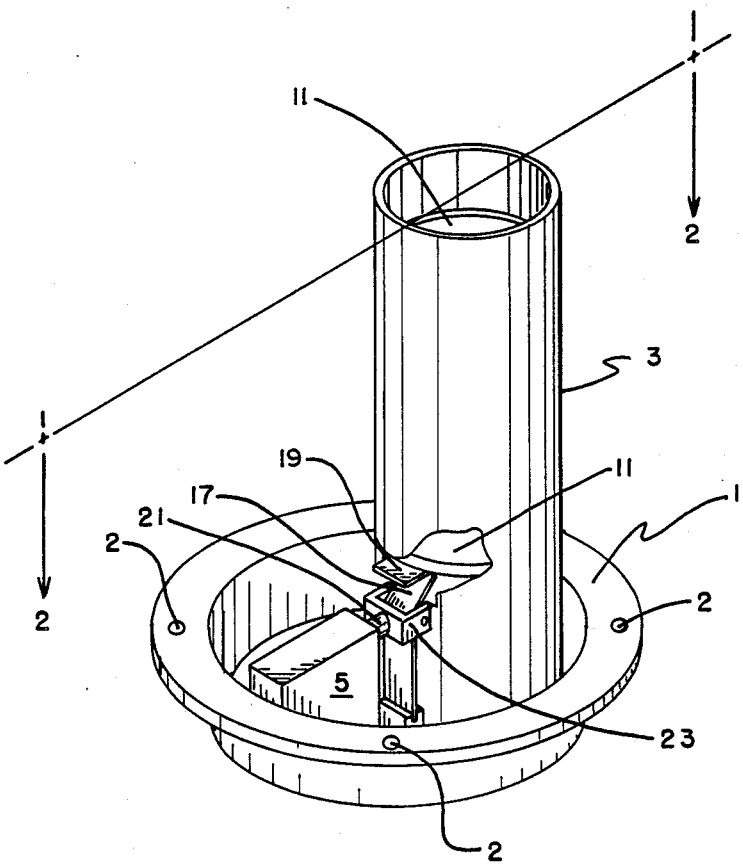
FIG. 1 is a perspective view showing the protective device of this invention.

There is illustrated in the drawings the protective device of this invention. The base of the protective device is a dished support plate 1 that has holes 2 in a flanged portion for mounting, as in a ceiling. The support plate 1 carries a housing 3, a solenoid 5, an impact plate 7, and a pivot point 9 (here illustrated as a nut and bolt) around which the impact plate 7 can be rotated.

Figure 2:
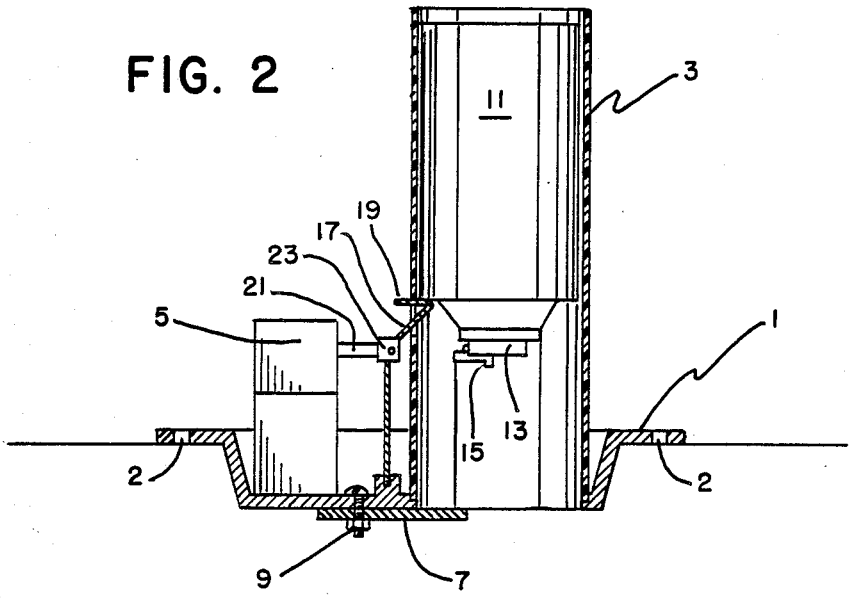
FIG. 2 is a view in section of the device shown in FIG. 1 taken in plane 2—2 illustrating the protective device in the armed position.
Figure 3:
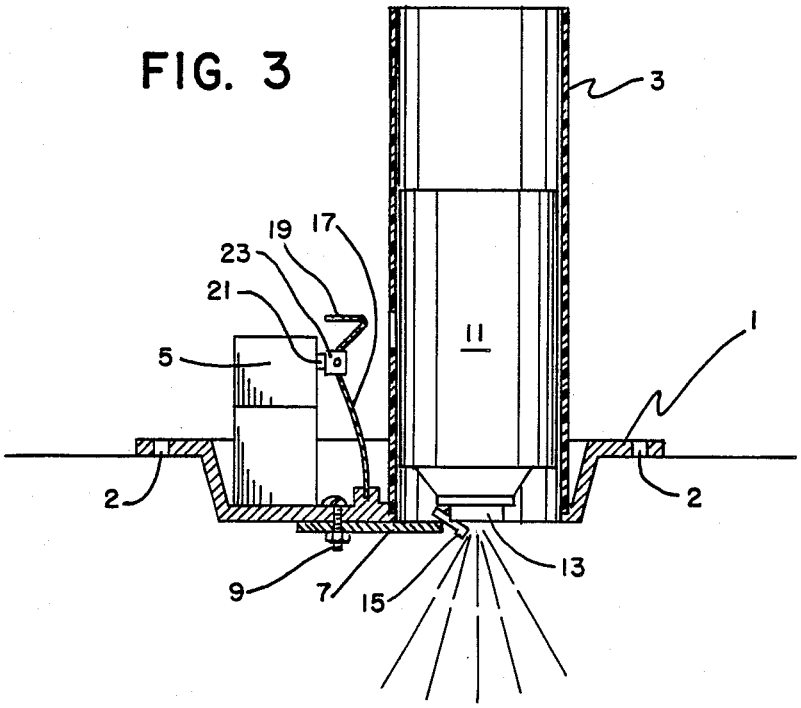
FIG. 3 is a view similar to FIG. 2 except that it shows the protective device in the discharge position.

Canister 11, in the inverted position, is contained within the housing 3 and, as shown in FIG. 2, has a nozzle 13 may be activated by release valve 15. A trigger mechanism 17, is made from a resilient material and is bent at its upper end to form canister support 19 which holds the canister 11 in an elevated position above the impact plate 7.

The trigger mechanism 17 is connected to a solenoid 5 by way of a retractable arm 21 and a linkage 23. Alternatively, trigger mechanism 17 can be connected directly to a cord arranged to be tripped by an intruder.

In operation, a canister 11 containing a noxious gas, such as tear gas, is inverted and placed within the housing 13. The canister 11 is held a substantial distance above the bottom of the housing 3 and the impact plate 7 by resting the canister 11 on the canister support 19. In this position, as shown in FIG. 2, the protective device is armed and ready for use.

Upon actuation of the solenoid 5 (or by mechanical action of a trip line, as noted above) the retractable arm 21 is actuated to move from the housing 3 and carries with it linkage 23 which, in turn, slides the canister support 19 out from under the canister 11 and so permitting the canister 11 to fall by gravity.

When the canister 11 falls to the bottom of housing 3, the release valve 15 strikes the impact plate 7 opening the release valve 15 and permit the gases under pressure in canister 11 to discharge into the surrounding area. In the preferred practice of this invention, the nozzle actuator 15 is of the type that when actuated, will remain open until all of the contents of the canister 11 have been discharged.

To rearm the protective device of this invention, the impact plate 7 is rotated about pivot point 9 to fully open the lower end of the housing 3 and allow and allow the canister 11 to be slipped out of the housing 3 as by gravity. When the solenoid 5 is de-energized (or a trip line is relaxed) the resilient trigger mechanism 17 will return to its original position and realign the canister support 19 to receive and support a charged canister. Arming of the device is then complete.

The protective device of this invention can be mounted on almost any type of support mechanism above floor level. A preferred mounting is in a ceiling, which would prove particularly convenient if it is a drop ceiling.

What is claimed is:

1. A protective anti-theft device which, when activated by an intruder, will release noxious gases under pressure from a canister into the surrounding environment, comprising:

a support plate;

a vertically disposed housing mounted on the support plate;

a trigger mechanism; and an impact plate mounted for rotation on the support plate from a first position partially covering the bottom of the housing to a second position opening the bottom of the housing;

the trigger mechanism being made from a resilient material mounted at its one end adjacent the bottom of the housing with its other end free to move away from the housing and having an at rest position adjacent the housing;

a canister support formed on the upper end of the trigger mechanism adapted to pass through an opening in the housing into the interior of the housing when the trigger mechanism is at its at rest position and to withdraw from the housing when the trigger mechanism is moved away from the housing;

activating means operatively connected with the trigger mechanism adapted to move the trigger mechanism from its at rest position adjacent the housing to away from the housing, whereby;

when a canister is placed within the housing it is supported by the upper surface of the canister support and is free to fall by gravity and strike the impact plate when the activating means causes the trigger mechanism to move away from the housing and the canister support is withdrawn from the housing.

* * * * *